US011325401B2

(12) United States Patent
Kanno et al.

(10) Patent No.: US 11,325,401 B2
(45) Date of Patent: May 10, 2022

(54) PRINTING APPARATUS AND CONTROL METHOD THEREFOR

(71) Applicant: SEIKO EPSON CORPORATION, Tokyo (JP)

(72) Inventors: Yusuke Kanno, Shiojiri (JP); Hiroyuki Endo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/884,357

(22) Filed: May 27, 2020

(65) Prior Publication Data

US 2020/0376859 A1 Dec. 3, 2020

(30) Foreign Application Priority Data

May 30, 2019 (JP) ..... JP2019-101038

(51) Int. Cl.
*B41J 2/01* (2006.01)
*B41J 11/00* (2006.01)
*B41J 11/02* (2006.01)

(52) U.S. Cl.
CPC ..... *B41J 11/0085* (2013.01); *B41J 11/02* (2013.01)

(58) Field of Classification Search
None
See application file for complete search history.

(56) References Cited

U.S. PATENT DOCUMENTS 8,152,296 B2 4/2012 Maekawa et al.
8,322,845 B2 12/2012 Maekawa et al.
2008/0036134 A1* 2/2008 Matsumoto ..... B65H 3/48 271/4.03
2012/0019584 A1* 1/2012 Uchiyama ..... B41J 11/0085 347/16
2012/0062672 A1* 3/2012 Toya ..... B41J 11/0085 347/104

FOREIGN PATENT DOCUMENTS

JP 2002-145470 A 5/2002
JP 2007316189 A * 12/2007
JP 5369760 B 9/2013

* cited by examiner

*Primary Examiner* — Erica S Lin
*Assistant Examiner* — Tracey M McMillion
(74) *Attorney, Agent, or Firm* — Workman Nydegger

(57) ABSTRACT

A printer for printing on rolled paper includes an air pressure sensor that detects air pressure, a platen that has a suction hole and is installed on a transport path of the rolled paper, a suction fan that sucks the rolled paper via the suction hole, and a control section that performs control for changing a rotation speed of the suction fan according to a detection result of the air pressure sensor.

5 Claims, 7 Drawing Sheets

PRINTING APPARATUS AND CONTROL METHOD THEREFOR

The present application is based on, and claims priority from JP Application Serial Number 2019-101038, filed May 30, 2019, the disclosure of which is hereby incorporated by reference herein in its entirety.

BACKGROUND

1. Technical Field

The present disclosure relates to a printing apparatus and a control method therefor.

2. Related Art

In related art, there is a printing apparatus that sucks a print medium onto a supporting member, such as a platen, to support the print medium. For example, JP-A-2002-145470 discloses a paper transport apparatus that sucks a sheet of paper onto a transport belt by suction of a vacuum box having an adjusting member capable of adjusting opening parts.

In the apparatus described in JP-A-2002-145470, since a suction force applied to a print medium varies due to a change in air pressure, there is a risk that the suction force is not fully applied to the print medium depending on the air pressure. Thus, in such an apparatus, the suction force needs to be adjusted according to the air pressure. However, in the configuration described in Document 1, in which a suction force is adjusted by a user, adjustment of the suction force can be troublesome to the user.

SUMMARY

An aspect of the present disclosure for solving the above problem is a printing apparatus including an air pressure sensor configured to detect air pressure, a print head configured to print on a print medium, a platen configured to include a suction hole and oppose to the print head, a suction fan configured to suck the print medium via the suction hole, and a control section configured to perform control for changing a rotation speed of the suction fan according to a detection result of the air pressure sensor.

In the above printing apparatus, when the air pressure sensor detects an air pressure lower than a first air pressure, the control section may perform control for changing the rotation speed of the suction fan to a rotation speed higher than a rotation speed set at a time when the air pressure sensor detects an air pressure higher than the first air pressure.

In the above printing apparatus, a memory section that stores a reference set value may be provided, and the control section may set the rotation speed of the suction fan to a value obtained by multiplying the reference set value stored in the memory section by a correction coefficient.

In the above printing apparatus, the memory section may store the reference set value in association with the type of the print medium.

In the above printing apparatus, the control section may use a first coefficient as the correction coefficient when the air pressure detected by the air pressure sensor is at or above a first threshold, may use a second coefficient as the correction coefficient when the air pressure detected by the air pressure sensor is at or below a second threshold, and may calculate the correction coefficient corresponding to the air pressure detected by the air pressure sensor when the air pressure detected by the air pressure sensor is between the first threshold and the second threshold.

Another aspect of the present disclosure for solving the above problem is a control method for a printing apparatus including a print head configured to print on a print medium, an air pressure sensor configured to detect air pressure, a platen configured to include a suction hole and oppose to the print head, and a suction fan configured to suck the print medium via the suction hole. In the control method, a rotation speed of the suction fan is changed according to a detection result of the air pressure sensor.

DESCRIPTION OF EXEMPLARY EMBODIMENTS

First Embodiment

Figure 1:
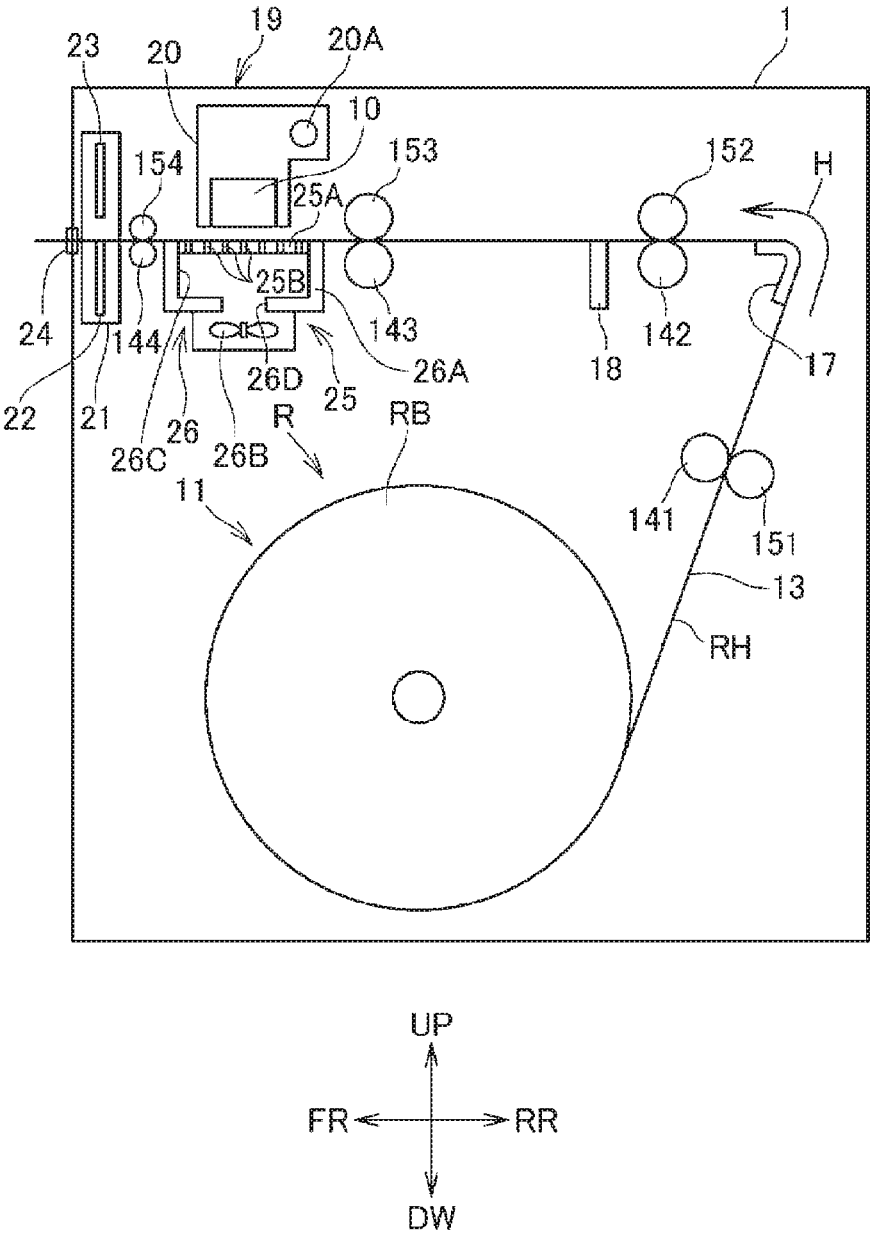
FIG. 1 is a schematic diagram showing a structure of a printer.

First, a first embodiment will be described. FIG. 1 is a schematic diagram showing a structure of a printer 1. The printer 1 is an example of a printing apparatus.

In FIG. 1, front, rear, up, and down directions of the printer 1 in an installed state are respectively indicated as FR, RR, UP, and DW.

The printer 1 is a serial ink jet printer that stores rolled paper R, transports the stored rolled paper R to a transport direction H, and prints an image on the rolled paper R by ejecting ink from an ink jet head 10, which is, for example, a serial head. The ink jet head 10 may be another type of ink jet head.

Figure 2:
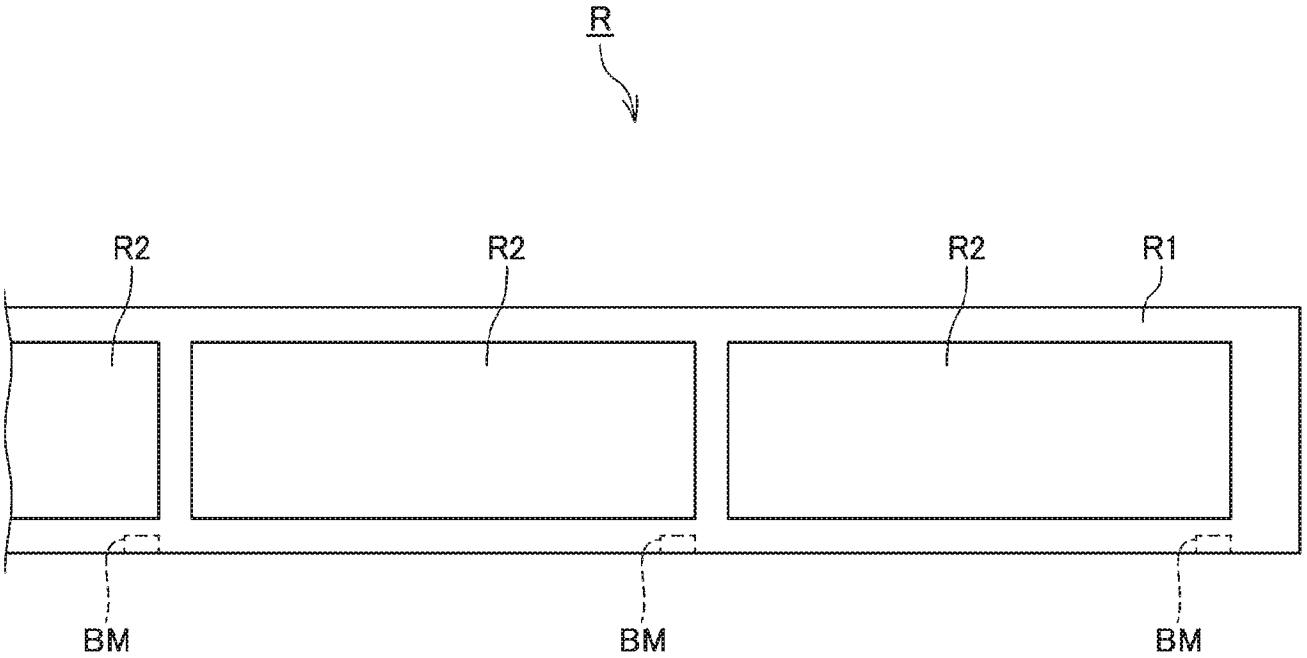
FIG. 2 is an example of rolled paper stored in the printer.

FIG. 2 is an example of the rolled paper R stored in the printer 1. The rolled paper R shown in FIG. 2 is a label paper sheet formed of a plurality of labels R2 pasted at intervals on long release paper R1. A label R2 has an adhesive underside and can be peeled off from the release paper R1 along a cut line. The length of the label R2 in a longitudinal direction is constant, and a space between adjacent labels R2 is constant, too. In the rolled paper R, images can be printed in areas corresponding to labels R2. The printer 1 forms dots on a label R2 by using the ink jet head 10 and prints an image by combination of dots.

As shown in FIG. 2, a black-colored mark called a black mark BM is provided for each label R2 on the back surface of the rolled paper R.

As shown in FIG. 1, the printer 1 includes a rolled paper storage section 11 to store the rolled paper R. In the explanation below, the part of the rolled paper R that is stored in the rolled paper storage section 11 is called a "roll body" and is referred to as RB. In addition, the part of the rolled paper R that is fed and transported from the roll body RB stored in the rolled paper storage section 11 is called "transported roll paper" and is referred to as RH. The transported roll paper RH is an example of print medium.

Note that, the rolled paper R may include the roll body RB and the transported roll paper RH, or may refer to the roll body RB.

As shown in FIG. 1, the printer 1 includes a transport path 13 along which the transported roll paper RH is transported. The transported roll paper RH fed from the roll body RB is transported along the transport path 13 in a transport direction H.

As shown in FIG. 1, in the transport path 13, four transport rollers 141, 142, 143, and 144 are provided in this order from upstream to downstream in the transport direction H. Driven rollers 151, 152, 153, and 154 are provided so as to face the respective transport rollers 141, 142, 143, and 144, and rotate following the rotation of the transport rollers 141, 142, 143, and 144. The transported roll paper RH is pinched by the transport rollers 141, 142, 143, and 144 and the driven rollers 151, 152, 153, and 154, and is transported in the transport direction H in accordance with rotation of the transport rollers 141, 142, 143, and 144. The transport rollers 141, 142, 143, and 144 are coupled to a transport motor (not shown) via a power transmission mechanism and rotate in accordance with driving of the transport motor. The number of the transport rollers is not limited to four, and may be any number. The number of the driven rollers is not limited to four, and may be any number.

As shown in FIG. 1, a guide member 17 is provided downstream of the transport roller 141 in the transport direction H. The guide member 17 touches the back surface of the transported roll paper RH to bend the transported roll paper RH, which is transported upward, toward a front direction. The guide member 17 imparts tension to the transported roll paper RH by touching and bending the transported roll paper RH, thereby preventing slack of the transported roll paper RH.

A black mark sensor 18 is provided downstream of the guide member 17 in the transport direction H. The black mark sensor 18 optically detects black marks BM provided on the back surface of the transported rolled paper RH. Based on a detected value of the black mark sensor 18, a control section 100, which will be described later, determines whether a black mark BM is located at a detection position of the black mark sensor 18. The control section 100 controls the position of the transported rolled paper RH based on the determination result.

A print unit 19 is provided downstream of the black mark sensor 18 in the transport direction H. The print unit 19 includes a carriage 20 and an ink jet head 10 (a print head) mounted on the carriage 20.

The carriage 20 is supported by a carriage shaft 20A extending in a direction orthogonal to the transport direction H, and allows the ink jet head 10 to move in the orthogonal direction along the carriage shaft 20A. The ink jet head 10 includes nozzle arrays of four colors: cyan, magenta, yellow and black (CMYK), for example. With supply of ink from an ink cartridge (not shown), the ink jet head 10 ejects droplets of ink from nozzles provided on each nozzle array and forms dots on the transported roll paper RH to print an image. Note that the ink jet head 10 is not limited to a head capable of printing in color using CMYK four colors. A head capable of printing in full color using multicolor inks including special colors in addition to CMYK four colors, for example, or a head capable of monochrome printing or two-color printing may be used, for example.

In the transport path 13, a suction platen unit 25 is provided at a position facing to (opposing to) the ink jet head 10. The suction platen unit 25 includes a platen 25A. The platen 25A extends over a range in which the ink jet head 10 can forms dots, and supports the transported roll paper RH in such a manner that the front surface of the transported roll paper RH located on the platen 25A is flatten so as to be perpendicular to an ejection direction into which ink is ejected from the ink jet head 10. The platen 25A has a plurality of suction holes 25B penetrating through the platen 25A in the thickness direction.

The suction platen unit 25 includes a suction unit 26. The suction unit 26 includes a box-shaped support base 26A having an opened top surface, and a suction fan 26B coupled to an exhaust port 26D of the support base 26A. The platen 25A is installed on the opening of the support base 26A, and a space surrounded by the support base 26A and the platen 25A serves as a negative pressure chamber 26C. On the bottom surface of the support base 26A, the exhaust port 26D penetrating through the bottom surface is formed. The suction fan 26B is coupled to the exhaust port 26D. In the suction unit 26, the suction fan 26B sucks out air from the negative pressure chamber 26C to generate a suction force on the transported roll paper RH via a plurality of the suction holes 25B, and the transported roll paper RH is thus attracted to the platen 25A via suction holes 25B. As a result, the suction unit 26 places the transported roll paper RH located on the platen 25A flat along the surface of the platen 25A. Note that, the platen 25A may be integrally formed with the support base 26A.

A cutter unit 21 is provided downstream of the print unit 19 in the transport direction H. The cutter unit 21 includes a fixed blade 22 and a movable blade 23 capable of moving to come in contact with the fixed blade 22. The cutter unit 21 moves the movable blade 23 to cut the transported roll paper RH. The movable blade 23 is an example of a first blade and the fixed blade 22 is an example of a second blade.

A paper output port 24 is provided downstream of the cutter unit 21 in the transport direction H. The transported roll paper RH is delivered outside a chassis of the printer 1 via the paper output port 24.

Figure 3:
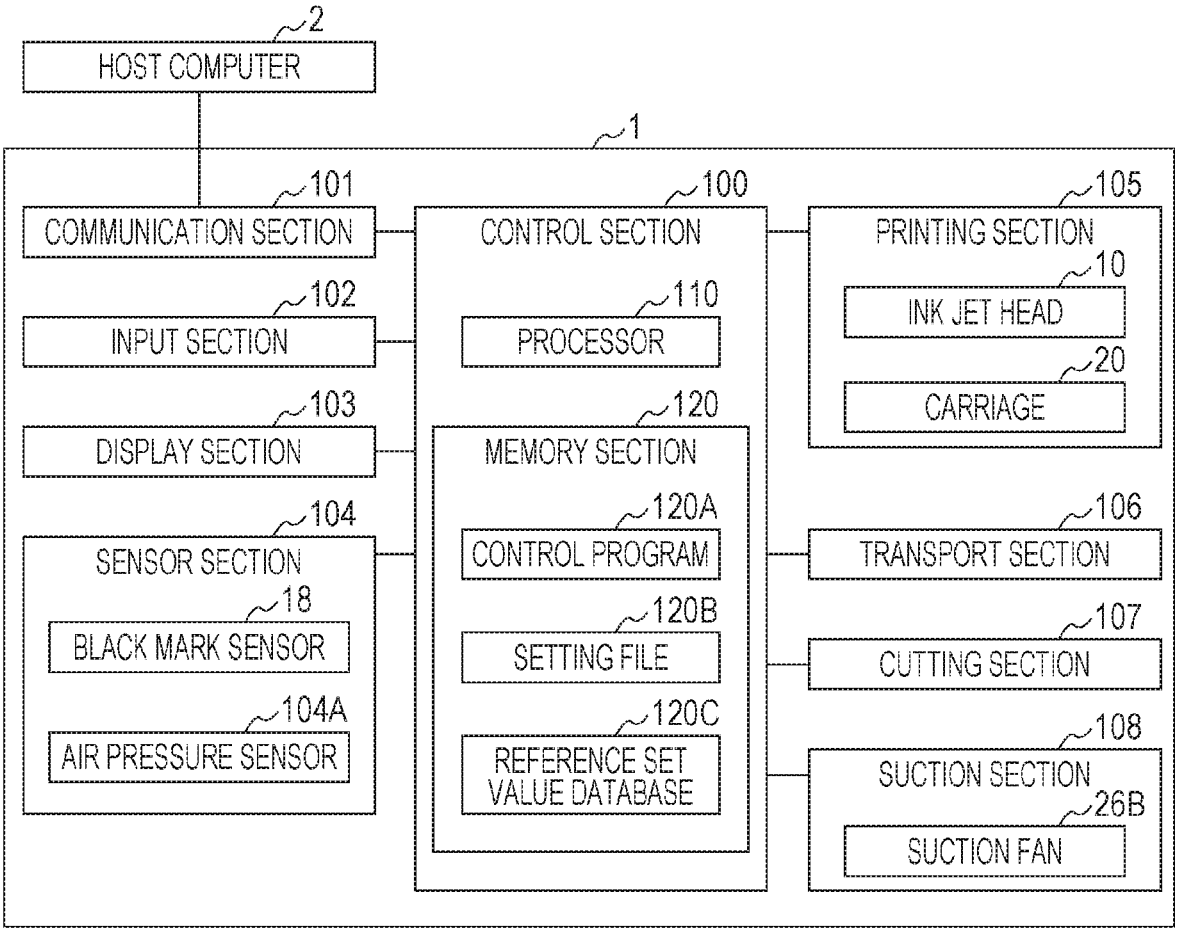
FIG. 3 is a block diagram showing a functional configuration of the printer.

FIG. 3 is a block diagram showing a functional configuration of the printer 1. The printer 1 includes the control section 100, a communication section 101, an input section 102, a display section 103, a sensor section 104, a printing section 105, a transport section 106, a cutting section 107, and a suction section 108.

The control section 100 includes a processor 110 that executes a program, such as a central processing unit (CPU) or a micro-processing unit (MPU), and a memory section 120, and controls each components of the printer 1. The control section 100 executes various processes by cooperation of hardware and software so that the processor 110 reads out a control program 120A stored in the memory section 120 to execute the process.

The memory section 120 has a storage area to store programs to be executed by the processor 110 and data to be processed by the processor 110. The memory section 120 stores a control program 120A to be executed by the processor 110 and other various data. The memory section 120 also stores a setting file 120B and a reference set value database 120C. The reference set value database 120C will be described later. In the setting file 120B, combinations of setting items related to settings of the printer 1 and set values corresponding to the setting items are stored. The memory section 120 has a non-volatile storage area to store programs and data in a non-volatile manner. The memory section 120 also includes a volatile storage area, and may construct a work area there to temporarily store programs and data that processor 110 executes and processes. The memory section 120 may be described as a memory.

The communication section 101 includes communication hardware meeting predetermined communication standards, and, through control of the control section 100, communicates with a host computer 2 that is a control device controlling the printer 1. Examples of the communication hardware include hardware such as a communication circuit, a communication port, a communication substrate, and a communication connector. A communication standard used between the communication section 101 and the host computer 2 may be any standard of wired communications or wireless communications.

The input section 102 includes input devices such as an operation switch and a touch panel provided on the printer 1. The input section 102 detects operation given to an input device and outputs a detection result to the control section 100. Based on an input from the input section 102, the control section 100 executes processing corresponding to the operation given to the input device.

The display section 103 includes one or a plurality of light-emitting diodes (LEDs) and a display device such as a display panel, and displays various information through control of the control section 100.

The sensor section 104 includes the black mark sensor 18, an air pressure sensor 104A, and other sensors, and outputs detection values of the sensors to the control section 100. The air pressure sensor 104A detects an internal air pressure of the printer 1 and outputs the detection value to the control section 100. Based on the detection value input from the air pressure sensor 104A, the control section 100 detects the internal air pressure of the printer 1. The air pressure sensor 104A is installed on, for example, a substrate on which the processor 110 included in the control section 100 is mounted.

The printing section 105 includes the ink jet head 10, a drive circuit that drives the ink jet head 10, the carriage 20, a motor that moves the carriage 20 to a direction orthogonal to the transport direction H, a motor driver that drives the motor, and other components engaging in printing on the rolled paper R. The printing section 105 prints an image on the rolled paper R through control of the control section 100.

The transport section 106 includes the transport rollers 141, 142, 143, 144, the driven rollers 151, 152, 153, 154, the transport motor that rotates the transport rollers 141, 142, 143, 144, a motor driver that drives the transport motor, and other components engaging in transport of the rolled paper R. The transport section 106 transports the rolled paper R through control of the control section 100.

The cutting section 107 includes the cutter unit 21, a moving motor that moves the movable blade 23 provided in the cutter unit 21, a motor driver that drives the moving motor, and other components engaging in cutting of the rolled paper R. The cutting section 107 cuts the rolled paper R through control of the control section 100.

The suction section 108 includes the suction unit 26, the suction motor that rotates the suction fan 26B provided in the suction unit 26, a motor driver that drives the suction motor, and other components engaging in suction of the rolled paper R located on the platen 25A. The suction section 108 sucks the rolled paper R located on the platen 25A through control of the control section 100.

When the printer 1 performs printing, the suction section 108 sucks and holds the transported roll paper RH on the platen 25A to prevent the transported roll paper RH from floating from the platen 25A, and as a result, deterioration in printing quality is suppressed. In general, the internal air pressure of the printer 1 varies due to a change in weather, the altitude at which the printer 1 is installed, or the like. When the internal air pressure of the printer 1 changes, the air density in the printer 1 also changes, and thus a suction force applied to the rolled paper R will change. In order to deal with the change, the control section 100 executes the operation below to automatically control a suction force to the rolled paper R according to the internal air pressure of the printer 1.

Figure 4:
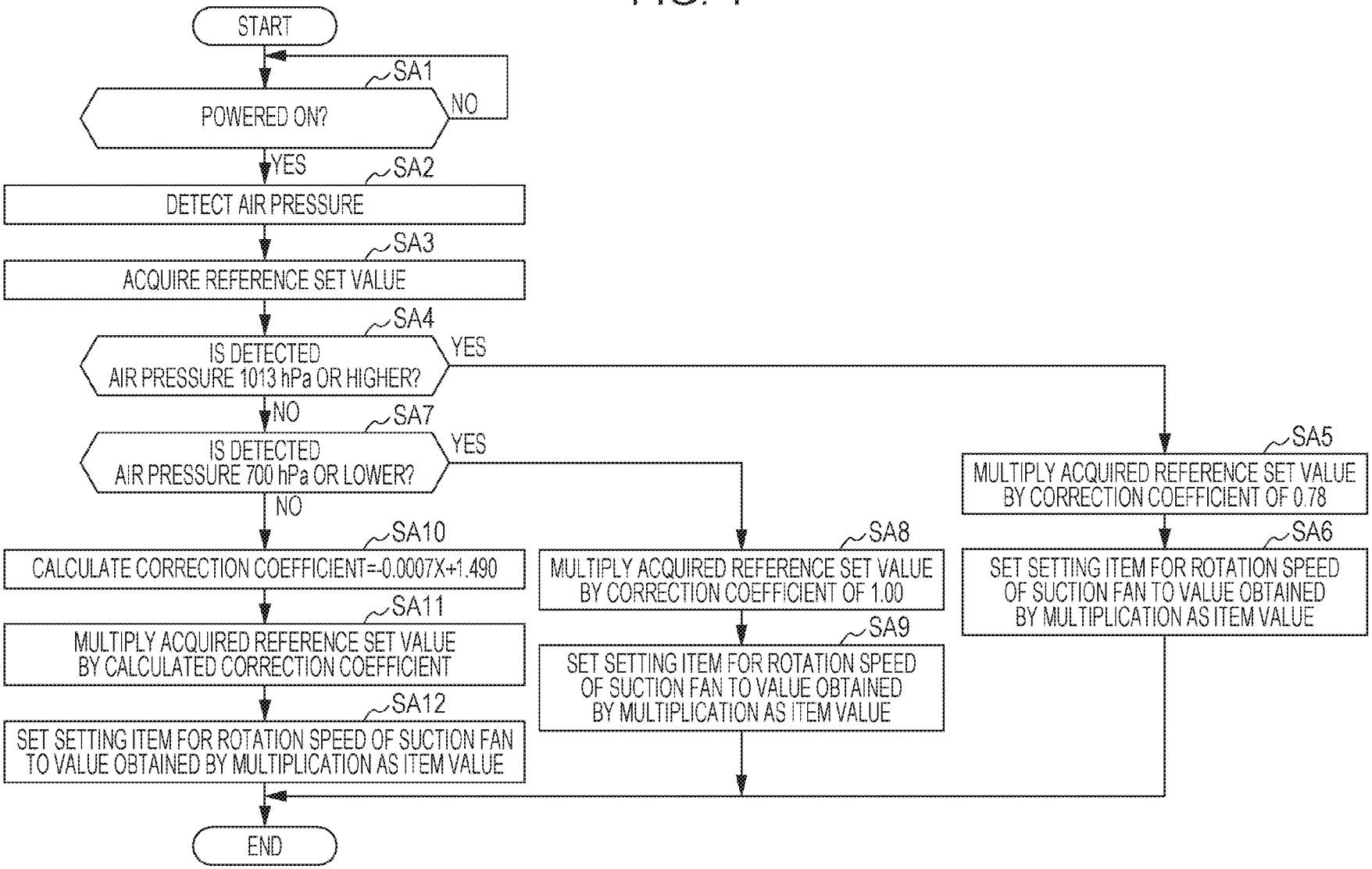
FIG. 4 is a flowchart showing operation of the printer.

FIG. 4 is a flowchart showing operation of the printer 1. The control section 100 of the printer 1 determines whether or not the printer 1 is powered ON (step SA1). For example, when the control section 100 receives, from the input section 102, an input indicating that a power switch is turned on, the control section 100 determines to be affirmative in step SA1.

When the control section 100 determines that the printer 1 is powered ON (YES in step SA1), the air pressure sensor 104A detects the internal air pressure of the printer 1 (step SA2).

Next, the control section 100 acquires, from the reference set value database 120C, a reference set value KST corresponding to the type of the rolled paper R set in the printer 1 (step SA3). Note that the control section 100 may execute processing of step SA3 before step SA2.

Figure 5:
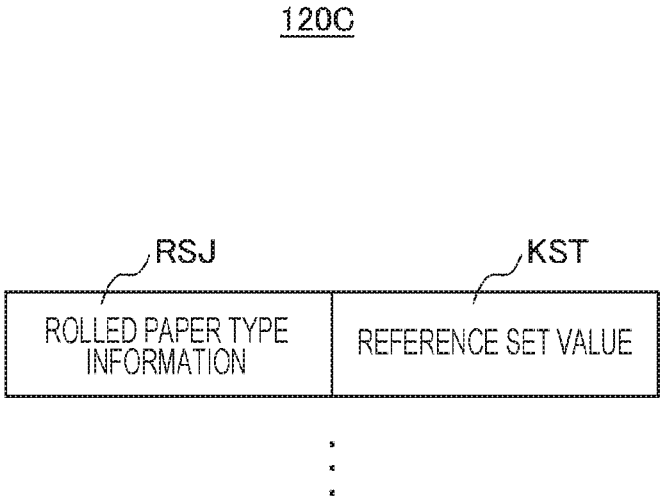
FIG. 5 is an example of reference set value database.

FIG. 5 is an example of the reference set value database 120C. Each record stored in the reference set value database 120C has rolled paper type information RSJ and a reference set value KST.

The rolled paper type information RSJ is information on the type of rolled paper R. In the present embodiment, the type of rolled paper R is specified by a combination of the length of the rolled paper R in the transverse direction, which is the width of the rolled paper R, and the size of a label R2. Therefore, the rolled paper type information RSJ of the present embodiment includes information on the width of rolled paper R and information on the size of label R2. Note that, the size of label R2 is specified by a combination of lengths in the transverse direction and in the longitudinal direction.

The reference set value KST is a value indicating the rotation speed per unit time of the suction fan 26B and is used as a baseline when the rotation speed is determined for the suction fan 26B in processing in step SA4 and the subsequent steps. Hereinafter, the rotation speed per unit time of the suction fan 26B is referred to simply as the rotation speed of the suction fan 26B. In the present embodiment, a case is explained as an example where the control section 100 controls a suction motor that rotates the suction fan 26B, by using a pulse width modulation (PWM) method. Thus, a value that indicates the rotation speed of the suction fan 26B is a duty cycle of a drive pulse signal for driving the suction motor. Note that a duty cycle is the fraction of ON time of a pulse signal relative to the total period of ON time and OFF time of the pulse signal. In other words, a duty cycle is the fraction of ON time of a pulse signal relative to a unit time.

The reference set value database 120C stores records having rolled paper type information RSJ and reference set values KST for rolled paper R that printer 1 can set.

The control section 100 executes the following processing in step SA3 to acquire, from the reference set value database 120C, a reference set value KST corresponding to the type of the rolled paper R set in the printer 1. That is, the control section 100 refers to the setting file 120B and acquires a set value set in a setting item indicating the width of the rolled paper R. The setting file 120B has a setting item indicating the width of the rolled paper R, and with a predetermined method, an item value indicating the width of rolled paper R to be set in the printer 1 is set in the setting item. Similarly, the control section 100 refers to the setting file 120B and acquires a set value set in a setting item indicating the size of the label R2. The setting file 120B has a setting item indicating the size of the label R2, and with a predetermined method, an item value indicating the size of the label R2 of the rolled paper R to be set in the printer 1 is set in the setting item in advance. After acquiring these item values from the setting file 120B, the control section 100 specifies, from the reference set value database 120C, a record that has the rolled paper type information RSJ indicating the type of the rolled paper R corresponding to the combination of the acquired item values. Then, the control section 100 acquires a reference set value KST that the specified record has, as the reference set value KST corresponding to the type of the rolled paper R set in the printer 1. The item value indicating the width of the rolled paper R and the item value indicating the size of the label R2 of the rolled paper R may be set, for example, by a user operation to the input section 102, or may be set from the host computer 2 via the communication section 101.

Returning to the explanation of the flowchart of FIG. 4, the control section 100 determines whether or not the internal air pressure detected in step SA2 is at or above 1013 hPa, which is the standard atmospheric pressure (step SA4). An air pressure of 1013 hPa, which is the standard atmospheric pressure, corresponds to an example of a first threshold.

When the control section 100 determines that the internal air pressure of the printer 1 detected in step SA2 is at or above 1013 hPa (YES in step SA4), the reference set value KST acquired in step SA3 is multiplied by a correction coefficient of 0.78 (step SA5). A correction coefficient of 0.78 corresponds to an example of a first coefficient.

Next, the control section 100 sets the value obtained by the multiplication in step SA5, as an item value, in the setting item of the setting file 120B indicating the rotation speed of the suction fan 26B (step SA6). Consequently, when the internal air pressure of the printer 1 is at or above 1013 hPa, the rotation speed of the suction fan 26B is set to a rotation speed corresponding to the value obtained by multiplying the reference set value KST acquired in step SA3 by 0.78.

Returning to the explanation of step SA4, when the control section 100 determines that the internal air pressure of the printer 1 detected in step SA2 is not at or above 1013 hPa, that is, the internal air pressure is less than 1013 hPa (NO in step SA4), the control section 100 determines whether or not the internal air pressure of the printer 1 detected in step SA2 is at or below 700 hPa (step SA7). An air pressure of 700 hPa corresponds to an example of a second threshold.

When the control section 100 determines that the internal air pressure of the printer 1 detected in step SA2 is at or below 700 hPa (YES in step SA7), the reference set value KST acquired in step SA3 is multiplied by a correction coefficient of 1.00 (step SA8). A correction coefficient of 1.00 corresponds to an example of a second coefficient.

Next, the control section 100 sets the value obtained by the multiplication in step SA8, as an item value, in the setting item of the setting file 120B indicating the rotation speed of the suction fan 26B (step SA9). Consequently, when the internal air pressure of the printer 1 is at or below 700 hPa, the rotation speed of the suction fan 26B is set to a rotation speed corresponding to the value obtained by multiplying the reference set value KST acquired in step SA3 by 1.00.

Returning to the explanation of step SA7, when the control section 100 determines that the internal air pressure of the printer 1 detected in step SA2 is not at or below 700 hPa, that is, the internal air pressure is higher than 700 hPa (NO in step SA7), a correction coefficient is calculated by using the following formula (1) (step SA10):

$$\text{Correction coefficient} = -0.0007X + 1.490 \quad (1).$$

In formula (1), X represents air pressure in hPa. Note that, when X is 1013 hPa in formula (1), the correction coefficient becomes 0.78, and when X is 700 hPa, the correction coefficient becomes 1.00.

The control section 100 calculates a correction coefficient by substituting the internal air pressure of the printer 1 detected in step SA2 into X in formula (1).

The control section 100 multiplies the reference set value KST acquired in step SA3 by the correction coefficient calculated in step SA10 (step SA11).

Then, the control section 100 sets the value obtained by the multiplication in step SA11, as an item value, in the setting item of the setting file 120B indicating the rotation speed of the suction fan 26B (step SA12). Consequently, when the internal air pressure of the printer 1 is less than 1013 hPa but higher than 700 hPa, the rotation speed of the suction fan 26B is set to a rotation speed corresponding to the value obtained by multiplying the reference set value KST acquired in step SA3 by the correction coefficient calculated using formula (1).

Figure 6:
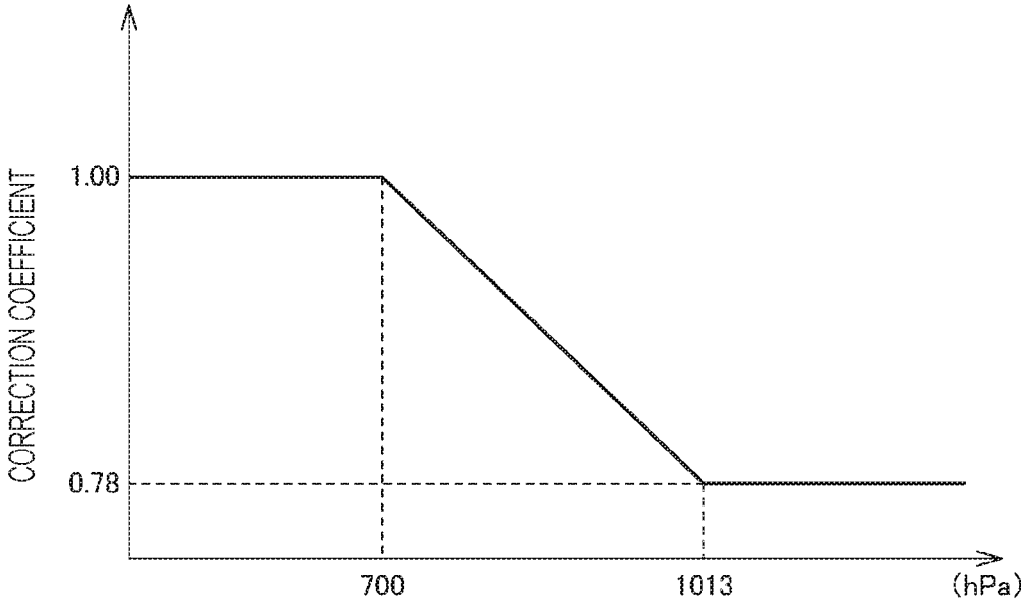
FIG. 6 is a graph showing a relation between correction coefficient and air pressure.

FIG. 6 is a graph showing a relation between the correction coefficient to be multiplied to the reference set value KST and the air pressure detected by the air pressure sensor 104A. In FIG. 6, the vertical axis indicates correction coefficient to be multiplied to the reference set value KST, and the horizontal axis indicates air pressure in hPa.

As shown in FIG. 6, when the internal air pressure of the printer 1 is at or below 700 hPa, the correction coefficient to be multiplied to the reference set value KST is 1.00. A correction coefficient of 1.00 is the maximum value to be multiplied to the reference set value KST. Therefore, when the internal air pressure of the printer 1 is at or below 700 hPa, the control section 100 does not set the rotation speed of the suction fan 26B to a rotation speed corresponding to a value larger than the reference set value KST acquired in step SA3. As described above, by setting an upper limit of the rotation speed, which is variable, for the suction fan 26B, the rotation speed of the suction fan 26B is not set to a rotation speed higher than the rotation speed corresponding to the reference set value KST even when the sensor section 104 detects an air pressure of 700 hPa or blow due to prescribed factors such as incorrect detection. As a result, noises and power consumption of the suction fan 26B can be prevented from becoming unnecessarily large due to prescribed factors.

In addition, as shown in FIG. 6, when the internal air pressure of the printer 1 is at or above 1013 hPa, the correction coefficient to be multiplied to the reference set value KST is 0.78. A correction coefficient of 0.78 is the minimum value to be multiplied to the reference set value KST. Therefore, when the internal air pressure of the printer 1 is at or above 1013 hPa, the control section 100 does not set the rotation speed of the suction fan 26B to a rotation speed corresponding to a value smaller than the reference set value KST acquired in step SA3. As described above, by setting a lower limit of the rotation speed, which is variable, for the suction fan 26B, insufficiency of a suction force applied to the rolled paper R can be prevented even when the sensor section 104A detects an air pressure of 1013 hPa or above due to prescribed factors such as incorrect detection.

Furthermore, as shown in FIG. 6, when the internal air pressure of the printer 1 is higher than 700 hPa and smaller than 1013 hPa, the correction coefficient to be multiplied to the reference set value KST decreases in proportion to the internal air pressure of the printer 1 from 0.78 to 1.00, and becomes smaller as the internal air pressure of the printer 1 becomes higher. Therefore, when the internal air pressure of the printer 1 is smaller than the 1013 hPa and larger than 700 hPa, the control section 100 sets, when the air pressure sensor detects an air pressure lower than a first air pressure, the rotation speed of the suction fan to a rotation speed higher than a rotation speed of the suction fan that is set when the air pressure sensor detects an air pressure higher than the first air pressure.

As described above, in general, as the internal air pressure of the printer 1 decreases, the suction force applied to the rolled paper R decreases because air density is reduced. For this reason, the control section 100 increases the rotation speed of the suction fan 26B as the internal air pressure of the printer 1 decreases. Thus, the control section 100 can automatically change the rotation speed of the suction fan 26B to an appropriate value according to the internal air pressure of the printer 1. In addition, since the control section 100 can automatically change the rotation speed of the suction fan 26B to an appropriate value according to the internal air pressure of the printer 1, a user does not need to adjust the rotation speed of the suction fan 26B by himself, and thus the user does not feel troublesome in the adjustment. Furthermore, since the control section 100 does not need a user operation to adjust the rotation speed of the suction fan 26B, a printing failure caused by floating of paper due to an adjustment error by a user can be avoided. Since the control section 100 increases a rotation speed of the suction fan 26B as the internal air pressure of the printer 1 decreases, the rotation speed of the suction fan 26B is not unnecessarily increased, and as a result, noises and power consumption of the suction fan 26B can be prevented from becoming unnecessarily large.

As described above, the printer 1 for printing on the rolled paper R includes the air pressure sensor 104A, the platen 25A that has suction holes 25B and is installed on the transport path 13 of the rolled paper R, the suction fan 26B that sucks the rolled paper R via the suction holes 25B, and the control section 100 that performs control for changing the rotation speed of the suction fan 26B according to a detection result of the air pressure sensor 104A.

According to this configuration, the control section 100 performs control for changing the rotation speed of the suction fan 26B according to a detection result of the air pressure sensor 104A and, as a result, the suction force applied to the rolled paper R can be automatically adjusted according to the air pressure. In addition, since the suction force applied to the rolled paper R can be automatically adjusted according to the internal air pressure of the printer 1, a user does not need to adjust the rotation speed of the suction fan 26B by himself, and thus the user does not feel troublesome in the adjustment.

When the air pressure sensor 104A detects an air pressure lower than a first air pressure, the control section 100 performs control for setting the rotation speed of the suction fan 26B to a rotation speed higher than the rotation speed of the suction fan 26B set at a time when the air pressure sensor 104A detects an air pressure higher than the first air pressure.

As described above, in general, as the internal air pressure of the printer 1 decreases, the suction force applied to the rolled paper R decreases because air density is reduced. For this reason, the control section 100 performs control to increase the rotation speed of the suction fan 26B as the internal air pressure of the printer 1 decreases. Thus, the control section 100 can automatically adjust the rotation speed of the suction fan 26B to an appropriate value according to the internal air pressure of the printer 1. In addition, since the control section 100 can automatically adjust the rotation speed of the suction fan 26B to an appropriate value according to the internal air pressure of the printer 1, a printing failure caused by floating of paper due to an adjustment error by a user can be avoided. In addition, since the control section 100 increases a rotation speed of the suction fan 26B as the internal air pressure of the printer 1 decreases, the rotation speed of the suction fan 26B is not unnecessarily increased, and as a result, noises and power consumption occurred in rotation of the suction fan 26B can be prevented from becoming unnecessarily large.

The printer 1 includes the memory section 120 that stores reference set values KST. The control section 100 sets the rotation speed of the suction fan 26B to a value obtained by multiplying a reference set value KST stored in the memory section 120 by a correction coefficient.

According to this configuration, since a value obtained by multiplying a reference set value KST stored in the memory section 120 by a correction coefficient is used to set the rotation speed of the suction fan 26B and so that the memory section 120 is not required to store much information about the rotation speed according to air pressure, the volume of information to be stored in the memory section 120 can be reduced. Therefore, the printer 1 can automatically adjust the suction force applied to the rolled paper R according to the internal air pressure of the printer 1 even when the memory section 120 stores less information.

The memory section 120 stores reference set values KST in association with the type of the rolled paper R.

According to this configuration, the suction force applied to the rolled paper R can be automatically adjusted according to the type of the rolled paper R and the internal air pressure of the printer 1. Therefore, the suction force can be automatically adjusted to an appropriate force according to the type of the rolled paper R.

The control section 100 uses a correction coefficient of 0.78 when the air pressure detected by the air pressure sensor 104A is at or above 1013 hPa. The control section 100 uses a correction coefficient of 1.00 when the air pressure detected by the air pressure sensor 104A is at or below 700 hPa. The control section 100 calculates a correction coefficient corresponding to the air pressure detected by the air pressure sensor 104A when the air pressure detected by the air pressure sensor 104A is between 700 hPa and 1013 hPa.

According to this configuration, upper and lower limits are set for correction coefficient, and a correction coefficient between the upper and lower limits is calculated corresponding to the air pressure. Therefore, a case where noises and power consumption of the suction fan 26B become unnecessarily large and a case where a suction force applied to the rolled paper R becomes inefficient are prevented from occurring due to prescribed factors such as incorrect detection of the air pressure sensor 104A, and, at the same time, the suction force applied to the rolled paper R can be automatically adjusted according to the internal air pressure of the printer 1.

Second Embodiment

Next, a second embodiment will be described. A printer 1 of the second embodiment differs from the printer 1 of the first embodiment in setting operation of the rotation speed for the suction fan 26B.

Figure 7:
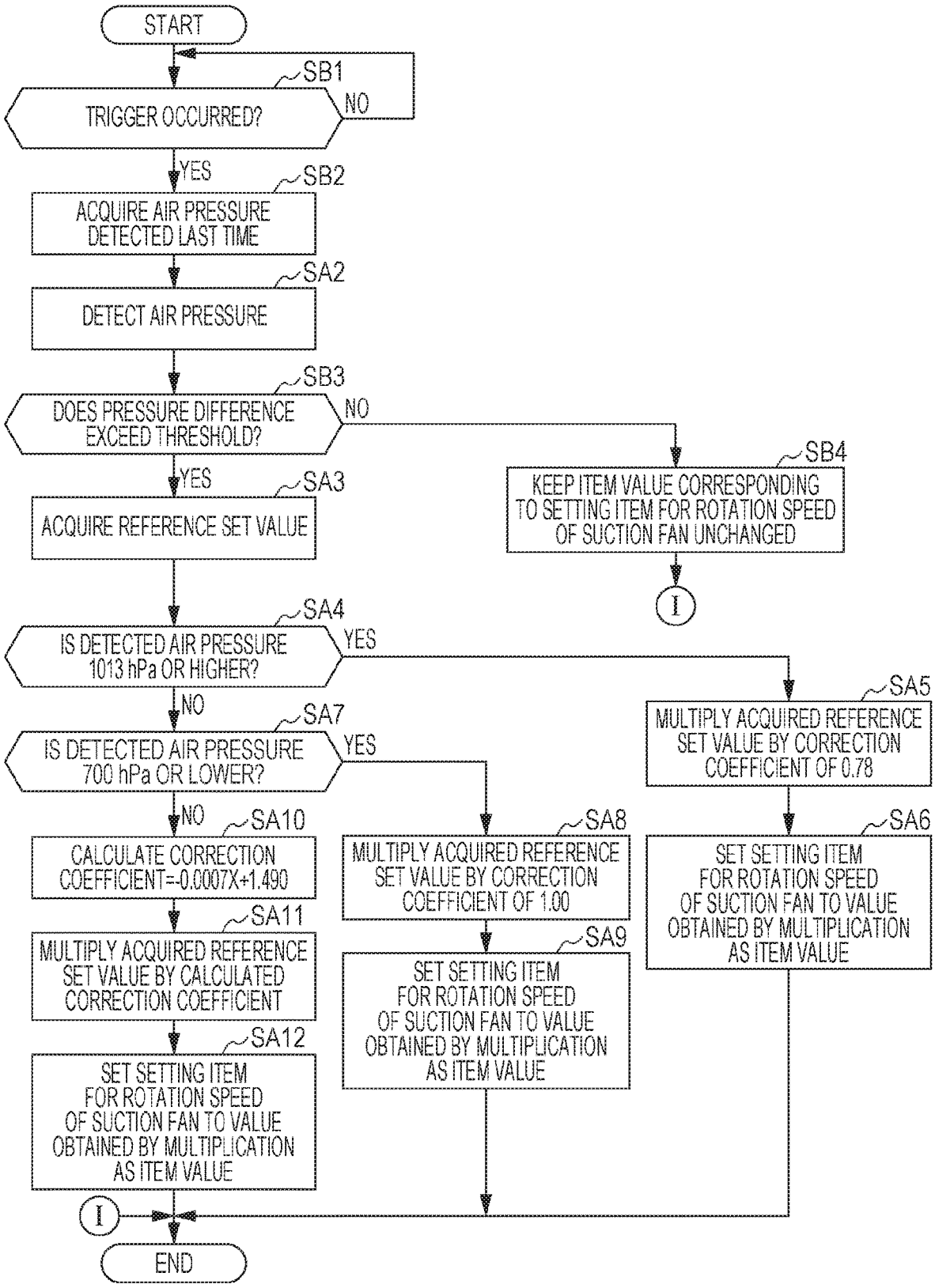
FIG. 7 is a flowchart showing operation of the printer.

FIG. 7 is a flowchart showing operation of the printer 1 of the second embodiment. In the flowchart of FIG. 7, the same steps are denoted by the same step numbers as those in the flowchart of FIG. 4, and the detailed explanations thereof are omitted unless necessary.

Suppose that, at the start of operation of the flowchart shown in FIG. 7, the memory section 120 stores an internal pressure of the printer 1, which was detected by the air pressure sensor 104 when the operation of the flowchart shown in FIG. 7 was executed last time.

The control section 100 of the printer 1 determines whether or not a trigger occurs (step SB1). For example, the control section 100 determines that a trigger occurs when the printer 1 is powered ON. The control section 100 also determines that a trigger occurs when an operation mode of the printer 1 is returned to a normal mode from a power saving mode, for example. Note that the power saving mode is an operation mode in which operation of the printer 1 is limited so as to reduce power consumption. The normal mode is an operation mode having no limit on the operation of the printer 1. The control section 100 also determines that a trigger occurs when the rolled paper R is changed, for example.

The control section 100 determines that a trigger occurs (YES in step SB1), the control section 100 acquires, from the memory section 120, the air pressure detected by the air pressure sensor 104A in the last operation (step SB2).

Next, the control section 100 detects an internal air pressure of the printer 1 by using the air pressure sensor 104A (step SA2).

Next, the control section 100 determines whether or not a difference between the air pressure acquired in step SB2 and the air pressure detected in step SA2 exceeds a predetermined threshold (step SB3). The predetermined threshold is appropriately defined through pretests or simulations, as a criterion for determining whether or not the rotation speed of the suction fan 26B is changed.

When the control section 100 determines that the difference between the air pressure acquired in step SB2 and the air pressure detected in step SA2 exceeds the predetermined threshold (YES in step SB3), the flow proceeds to step SA3.

Meanwhile, when the control section 100 determines that the difference between the air pressure acquired in step SB2 and the air pressure detected in step SA2 does not exceed the predetermined threshold (NO in step SB3), the item value set in the setting item indicating the rotation speed of the suction fan 26B in the setting file 120B is not changed (step SB4). That is, the control section 100 does not change the rotation speed of the suction fan 26B, and the same rotation speed as the last operation is set.

As described above, in the second embodiment, the rotation speed of the suction fan 26B is changed according to the pressure detected in the current operation when the difference between the internal air pressure of the printer 1 detected in the last operation and the that detected in the current operation exceeds the predetermined threshold, while the rotation speed of the suction fan 26B is not changed when the difference does not exceeds the predetermined threshold. Consequently, not only can the suction force applied to the rolled paper R be automatically adjusted to an appropriate suction force according to the internal air pressure of the printer 1, but also the suction force can be stabilized when a change in the air pressure is smaller than the predetermined threshold. Therefore, the printer 1 of the second embodiment can apply a more stable suction force to the rolled paper R.

Each of the embodiments described above is only an aspect of the present disclosure, and any modification or application is possible within the scope of the present disclosure.

For example, in each of the embodiments described above, a serial-type ink jet printer is described as an example of the printer 1, however, the printer 1 is not limited to a serial-type printer, and may be a line-type ink jet printer. In addition, a printing method of the printer 1 is not limited to an ink jet method, and may be a thermal method or other printing method.

Furthermore, in each of the embodiments described above, a label paper sheet on which black marks BM are formed is described as an example of the rolled paper R, however, the rolled paper R to be set in the printer 1 may be a label paper sheet having no black marks BM formed thereon, for example. The rolled paper R to be set in the printer 1 is not limited to a label paper sheet, and may be any print medium that is wound into a roll shape. In addition, in each embodiment, rolled paper R is described as an example of the print medium, however, the print medium is not limited to the rolled paper R, and may be a print medium of other form such as a continuous paper sheet or cut paper sheet.

In each of the embodiments described above, a configuration in which the control section 100 controls a suction motor of the suction fan 26B by using PWM is described as an example, however, a configuration in which the control section 100 controls the rotation of the suction motor based on the magnitude of a current may be used, for example. In such a case, a reference set value KST stored in the reference set value database 120C is a value indicating the magnitude of a current.

In each of the embodiments described above, a configuration in which the air pressure sensor 104A detects the internal air pressure of the printer 1 is described, however, a configuration in which outside air pressure is detected may be used, for example.

In addition, in each of the embodiments described above, a case in which the type of rolled paper R is determined by the combination of the length of the rolled paper R in the transverse direction and the size of a label R2 is described as an example, however, the type of the rolled paper R may be specified by using more or less factors, for example. In addition to the above-mentioned factors, the type of the rolled paper R may be specified by using other factors such as the thickness of the release paper R1 and the length of the rolled paper R in a longitudinal direction. In such a case, rolled paper type information RSJ includes information on the factors used to specify the type of rolled paper R. In addition, the setting file 120B includes setting items for the factors used to specify the type of rolled paper R and item values corresponding to the setting items.

In addition, in each of the embodiments described above, cases in which the first threshold is 1013 hPa, the second threshold is 700 hPa, the first coefficient is a correction coefficient of 0.78, and the second coefficient is a correction coefficient of 1.00 are described as examples, however, the first threshold, the second threshold, the first coefficient, and the second coefficient are not limited to the above-mentioned values. The first threshold may be any value larger than the second threshold, and the first coefficient may be any value smaller than the second coefficient. Note that, in formula (1), the slope and the intercept on the right side are associated with the first threshold, the second threshold, the first coefficient, and the second coefficient.

In addition, when the control method of the printer 1 described above is implemented by using, for example, a computer provided in the printer 1 or an external device connected to the printer 1, the present disclosure may be configured using a program that the computer executes to implement the method, and a computer-readable recording medium storing the program or a transmission medium transmitting the program, for example.

In addition, functions of the control section 100 may be achieved by multiple processors or a semiconductor chip, for example.

In addition, each section shown in FIG. 3 is an example, and a specific implementation thereof is not particularly limited. That is, mounting of hardware is not necessarily required for each section and a configuration in which functions of sections are achieved by executing programs by a single processor can also be used. In the above embodiments, some of the functions that are achieved by software may be achieved by hardware or some of the functions that are achieved by hardware may be achieved by software. In addition, for specific details of other sections of the printer 1, any modification is possible within the scope of the present disclosure.

In addition, for example, the step units of operations shown in FIG. 4 and FIG. 7 are defined by dividing main processing contents to facilitate understanding of the operation of each section of the printer 1. The present disclosure should not be limited by the names or ways of dividing processing into units. According to processing contents, processing may be divided into smaller step units. Conversely, one step unit may include more processing contents. The order of the steps may be changed, as appropriate, as long as the object of the present disclosure is not impaired.

What is claimed is:

1. A printing apparatus comprising:

an air pressure sensor configured to detect air pressure;

a print head configured to print on a print medium;

a platen configured to include a suction hole and oppose to the print head;

a suction fan configured to suction the print medium via the suction hole; and a control section configured to set a rotation speed of the suction fan according to the air pressure, wherein:

when the air pressure sensor detects that the air pressure is higher than a first air pressure, the control section is configured to set the rotation speed of the suction fan to a first rotation speed that is a fixed speed;

when the air pressure sensor detects that the air pressure is lower than a second air pressure, the control section is configured to set the rotation speed of the suction fan to a second rotation speed that is another fixed speed that is higher than the first rotation speed; and when the air pressure sensor detects that the air pressure is between the first air pressure and the second air pressure, the control section is configured to set the rotation speed of the suction fan to a third rotation speed that is changeable according to the detected air pressure.

2. The printing apparatus according to claim 1, further comprising a memory section that stores a reference set value, wherein the control section is configured to set the rotation speed of the suction fan to a value obtained by multiplying the reference set value stored in the memory section by a correction coefficient.

3. The printing apparatus according to claim 2, wherein the memory section stores the reference set value in association with a type of the print medium.

4. The printing apparatus according to claim 2, wherein the control section is configured to use a first coefficient as the correction coefficient when the air pressure detected by the air pressure sensor is at or above a first threshold, the control section is configured to use a second coefficient as the correction coefficient when the air pressure detected by the air pressure sensor is at or below a second threshold, and the control section is configured to calculate the correction coefficient corresponding to the air pressure detected by the air pressure sensor when the air pressure detected by the air pressure sensor is between the first threshold and the second threshold.

5. A control method for a printing apparatus including a print head configured to print on a print medium, an air pressure sensor configured to detect air pressure, a platen configured to include a suction hole and oppose to the print head, and a suction fan configured to suction the print medium via the suction hole, the control method comprising:

setting a rotation speed of the suction fan to a first rotation speed, when the air pressure sensor detects that the air pressure is higher than a first air pressure, and wherein the first rotation speed is a fixed speed; and setting the rotation speed of the suction fan to a second rotation speed that is higher than the first rotation speed, when the air pressure sensor detects that the air pressure is lower than the first air pressure, and wherein the second rotation speed is changeable according to the detected air pressure.

* * * * *